United States Patent [19]

Deal

[11] Patent Number: 4,807,880

[45] Date of Patent: Feb. 28, 1989

[54] BALL SUPPORT DEVICE

[76] Inventor: James S. Deal, 1463 43rd. Ave., San Francisco, Calif. 94122

[21] Appl. No.: 131,444

[22] Filed: Dec. 11, 1987

[51] Int. Cl.[4] ..... A63B 67/00

[52] U.S. Cl. ..... 273/55 B

[58] Field of Search ..... 273/55 B; D21/209

[56] References Cited

U.S. PATENT DOCUMENTS

| | | | |
|---|---|---|---|
| D. 235,462 | 6/1975 | Pennington | 273/55 B X |
| 1,608,361 | 11/1926 | Boettcher | 273/55 B |
| 3,105,686 | 10/1963 | Elsea | 273/55 B |
| 3,439,916 | 4/1969 | Kopp | 273/55 B |
| 3,462,145 | 8/1969 | Shirley et al. | 273/55 B |
| 3,762,706 | 10/1973 | Cavett | 273/55 B |
| 3,897,948 | 8/1975 | Gerela | 273/55 B |
| 4,477,077 | 10/1984 | Ferrebee | 273/55 B |
| 4,546,974 | 10/1985 | Brown | 273/55 B |
| 4,632,395 | 12/1986 | Ferrebee | 273/55 B |
| 4,634,122 | 1/1987 | Kline | 273/55 B |

*Primary Examiner*—Robert E. Garrett
*Assistant Examiner*—Joseph M. Pitko
*Attorney, Agent, or Firm*—Douglas E. White

[57] ABSTRACT

The present invention is a jig or tee for supporting a football, comprising a platform having sloping edges; calls or pins projecting from the lower surface of the platform for securing the tee into the ground; and a resilient ball support arm slideably passing through an aperture in the platform.

12 Claims, 2 Drawing Sheets

BALL SUPPORT DEVICE

FIELD OF THE INVENTION

This invention relates to a football kicking tee, jig or holding device, more particularly to a device which may be used to hold footballs for realistic practice in preparation for either amateur or professional football.

BACKGROUND OF THE INVENTION

Accuracy in place-kicking is an essential ingredient of success in the sport of football, as it is played under professional and amateur American rules. This kick is employed in actual play with one player assisting the kicker by supporting the football in a slightly inclined upright position by pressing its upper tip downwardly with his index finger. The lower tip of the ball engages either the playing field (under professional rules) or a platform "tee" (under amateur rules).

To obtain expertise in place kicking, it is necessary to spend a great deal of time in practice. However, it is an inefficient use of manpower in practice sessions to dedicate a player simply to hold the ball for the place-kicker, particularly since little skill or practice is necessary to perform the holding function. If the kicker wishes to practice on his own away from the team, a holder will be unavailable, by definition.

For this reason, a wide variety of devices for holding the football during place-kicking practice have been proposed, but none are known to have enjoyed wide commercial success.

Prior developments in this field will be generally illustrated by reference to the following patents:

| U.S. Pat. No. | Patentee | Issue Date |
|---|---|---|
| 4,634,122 | Kline | 01/06/87 |
| 3,762,706 | Cavett | 10/02/73 |
| 4,632,395 | Ferrebee | 12/30/86 |
| 3,462,145 | Shirley et al. | 08/19/69 |
| 4,546,974 | Brown | 10/15/85 |
| 3,439,916 | Kopp | 04/22/69 |
| 4,477,077 | Ferrebee | 10/16/84 |
| 3,105,686 | Elsea | 10/01/63 |
| 3,897,948 | Gerela | 08/05/75 |

U.S. Pat. Nos. 4,632,395, 4,546,974, 3,462,145 and 3,105,686 show football tees where the ball support has ground spikes to hold the device secure.

U.S. Pat. Nos. 4,634,122, 3,897,948, 3,439,916, 4,477,077 and 3,762,706 teach football tees with flexible or adjustable upper ball supports.

None of the prior art patents describe a device which is of simple, inexpensive construction that may be used to practice for either amateur or professional ball.

SUMMARY OF THE INVENTION

The present invention is a jig or tee for supporting a football, comprising a platform having sloping edges; calks or pins projecting from the lower surface of the platform for securing the tee into the ground; and a resilient ball support arm slideably passing through an aperture in the platform.

To use the tee for practicing amateur football, e.g. high school or college football (where the ball rests on a platform in actual play), one presses the calks of the platform into the ground and places a ball on its upper surface. The pointed end of the support arm is then passed through the aperture into the ground to a depth where a knob on the upper end of the arm presses against the top of the ball and holds it in the desired position for kicking. The slope of the edges of the platform ensure that the kicker's feet do not catch on the platform when it is struck with a low kick.

To use the device for practicing professional football (where the ball rests on the ground in actual play), the support arm easily may be disengaged from the platform and its pointed end pressed directly into the ground.

FEATURES AND ADVANTAGES

An object of this invention is to provide a tee which eliminates the unnecessarily complexity of prior art tees so that a durable product may be inexpensively produced.

Another object is to make the device simple to set up, operate and adjust.

It is also desired to provide one device which may be used to simulate the playing conditions of American football, under both amateur and professional rules.

A feature of the invention is a platform having an aperture, through which passes a J-spike, and having bevelled edges.

Another feature is a straight shaft portion of the J-spike which has a cross-section of uniform shape and size from its pointed bottom end up to a curved upper ball holding and tensioning portion. The J-spike may be disengaged from the platform and inserted into the ground to hold a ball without a kicking platform or block.

Yet another feature of the invention is pointed calks projecting from the lower surface of the platform for securing the device into the ground.

Other novel features which are characteristic of the invention, as to organization and method of operation, together with further objects and advantages thereof will be better understood from the following description considered in connection with the accompanying drawing in which a preferred embodiment of the invention is illustrated by way of example. It is to be expressly understood, however, that the drawing is for the purpose of illustration and description only and is not intended as a definition of the limits of the invention.

Certain terminology and derivations thereof may be used in the following description for convenience in reference only and will not be limiting. For example, the words "upwardly," "downwardly," "leftwardly," and "rightwardly" will refer to directions in the drawings to which reference is made. The words "inwardly" and "outwardly" will refer to directions toward and away from, respectively, the geometric center of a device and designated parts thereof.

DRAWING REFERENCE NUMERALS

Figure 2:
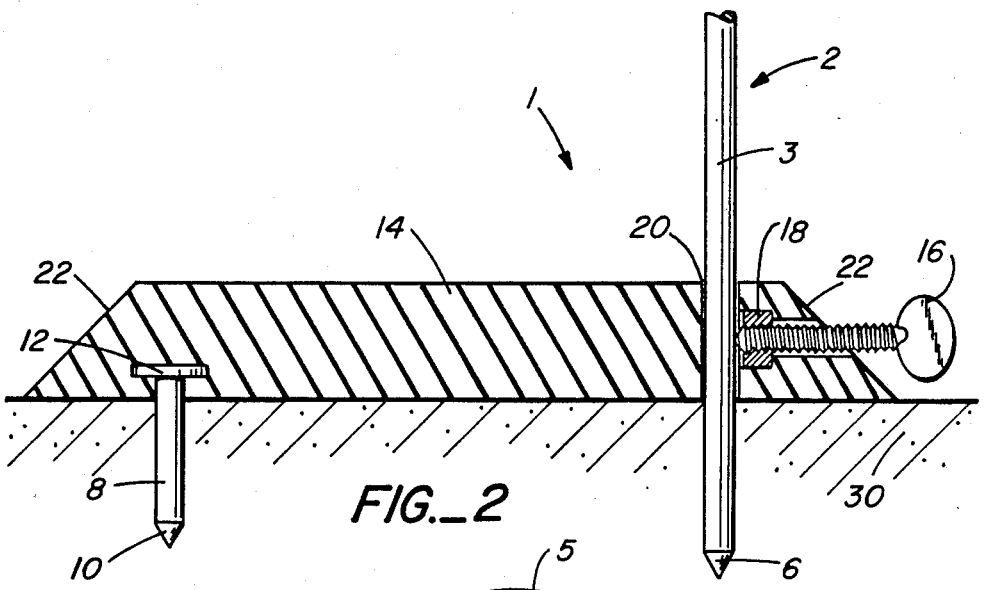
FIG. 2 is part sectional fragmentary front elevational view of the device of FIG. 1.

1 ball support device
2 support arm of 1
3 straight shaft portion of 2
4 knob of 2

5 curved tensioning portion of 2
6 pointed end of 2
8 calk or pin
10 pointed bottom end of 8
12 embedded top end of 8
14 platform
16 thumbscrew
18 nut of 16
20 aperture in 14
22 edge of 14
30 ground
32 turf
34 ball

DESCRIPTION OF THE PREFERRED EMBODIMENT

Figure 1:
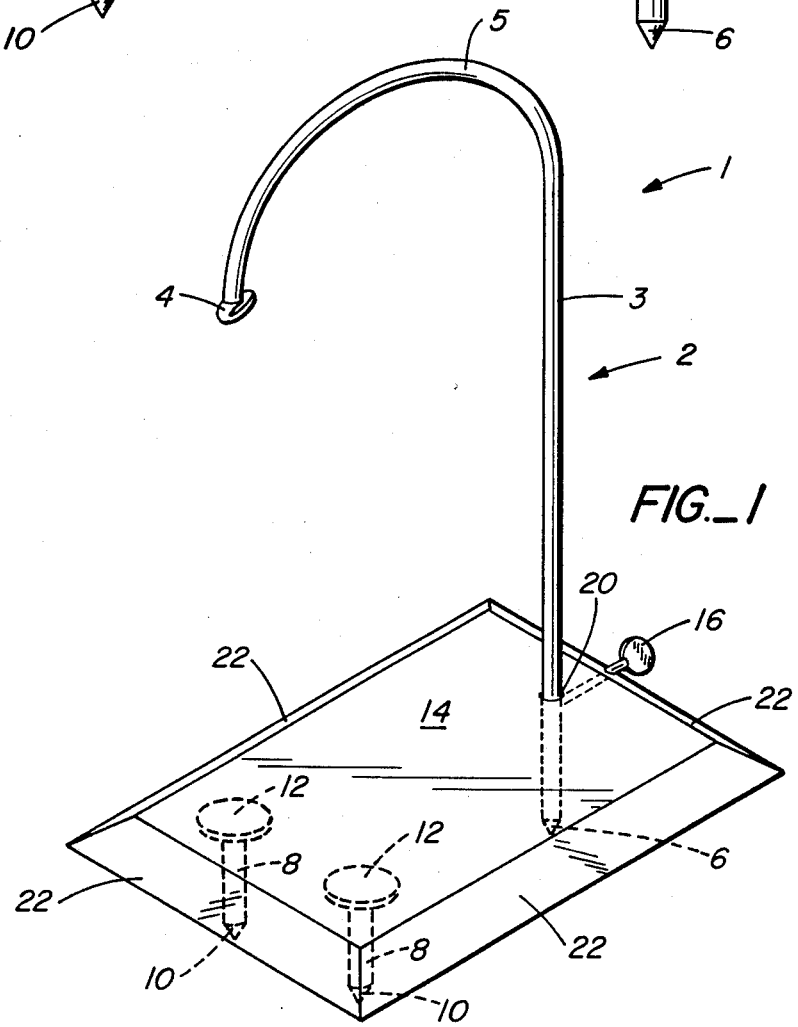
FIG. 1 is a perspective view of a preferred embodiment of the ball support device of the present invention.

Referring to FIG. 1, there is illustrated therein a ball support tee, jig or holding device, generally referred to as 1. Smoothly cylindrical ball support arm 2 is slideably engaged within cylindrical aperture 20 which pierces platform or base 14.

Platform 14 is preferably made of rubber or a similar resilient, impact-resistant, polymer plastic material. However, the platform of the ball support device could also be made of a non-resilient material such as steel, wood or the like.

All four side edges 22 are bevelled, canting outwardly from the top surface of platform 14 to the bottom surface thereof.

Partially embedded within platform 14 and projecting downwardly from the bottom surface thereof, are a plurality, preferably two, of calks or pins 8 terminating in pointed bottom ends 10. Calks 8 may have enlarged top ends 12 to retain them within platform 14.

Referring briefly to FIG. 2, it can be seen that the pointed end 6 of the support arm 2 may be used in conjunction with the plurality of calks 8 to secure the device by pressing points 6,10 into the ground 30 of the practice playing surface.

Once both platform 14 and arm 2 are inserted into the ground to the desired depth, thumbscrew 16 may be turned about embedded nut 18 until thumbscrew 16 compresses against and secures arm 2 in position, both vertically and rotationally (with respect to the axis of rotation passing through aperture 20).

Arm 2 has a straight, smoothly cylindrical shaft portion 3 of length substantially greater than the maximum ball diameter expected to be encountered. Portion 3 has a uniform circular cross-section slightly less than that of the congruent cylindrical aperture 20 in the platform 14. This allows the arm 2 to slide freely up and down and back and forth within the aperture 20 when the screw 16 is loosened. The device thus may be easily adjusted to a wide variety of ball sizes and positions without the need for the complicated positioning apparatus characteristic of the prior art.

Arm 2 has a curved upper tensioning portion 5 which preferably terminates in a knob 4. Arm 2 thus forms an inverted "J" shaped spike or stake.

To practice ball games with rules allowing or requiring a block on the ground to support the ball in, for example, place kicking (chiefly high school and college football), the device is used as follows.

Platform 14 is staked into the ground 30 with calks 8. A ball (not illustrated for this method of play) is placed on the upper surface of platform 14 and arm or J-spike 2 is pressed through aperture 20 into the ground until knob 4 presses against the top of the ball. This deforms tensioning portion 5 slightly and secures the ball to the platform 14. Platform 14 simulates the block that will be used in actual play.

At this point, the player tilts the ball to the desired vertical angle by rotating shaft 3 about the axis of aperture 20. The thumbscrew 16 may then be tightened. The player may withdraw and kick the ball without the aid of a second player to hold it.

In the case of hard ground, it will often not be necessary to use the thumbscrew because the pointed end 6 allows the arm 2 largely to secure itself within the ground. For this reason, equivalent embodiments may be designed without the thumbscrew or any replacement therefor.

The bevelled edges 22 ensure that the player's foot will not be injured or grossly deflected by contact with platform 14. As all edges are bevelled, the holding device may be used by either right or left footed players merely by placing the J-spike 2 on the right or left side of the platform with respect to the player.

Figure 3:
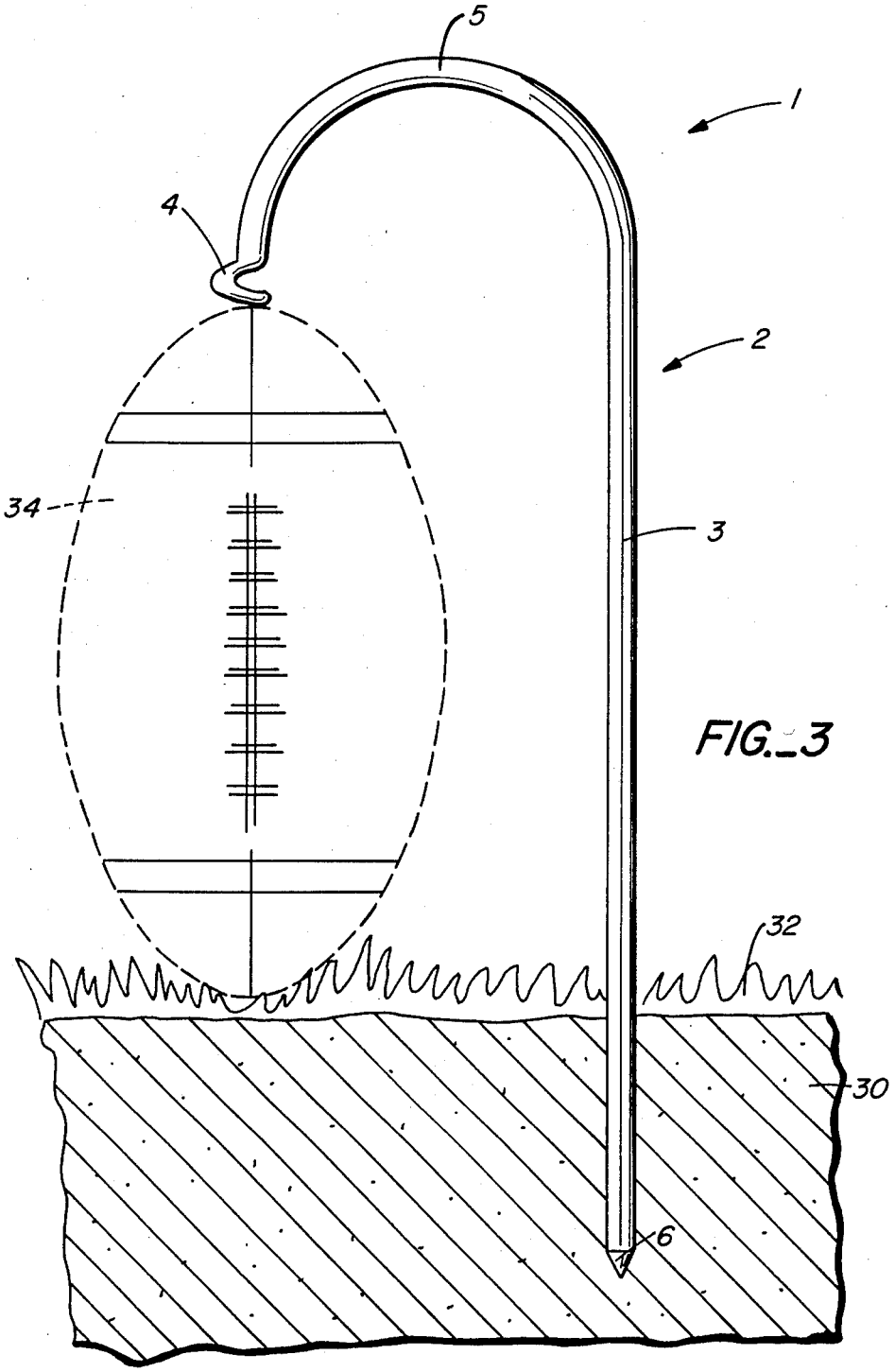
FIG. 3 is a front elevational view of a detached portion of the device of FIG. 1 showing a ball held in phantom.

Turning to FIG. 3, use of the device 1 for professional rules is therein illustrated. As professional football does not allow the use of a support block, it would be somewhat ineffectual to practice with a device containing a support platform as is found in the prior art. In the instant invention, however, J-spike 2 may be used alone without platform 14. Support arm 2 terminates in a pointed end 6, unlike prior art devices. This feature, along with the smooth, unobstructed, and uniformly cylindrical nature of arm 2, allows the device to be used both with or without the platform 14.

End 6 of arm or J-spike 2 is pressed directly into ground 30 to a depth at which knob 4 presses football 34, shown in phantom, into position on turf 32. Knob 4 simply comprises a slightly enlarged end of tensioning portion 2 of any shape or size sufficient to present a substantial ball gripping area, and corresponds to the finger of the ball holder which is replaced by the holding device 1.

While the above provides a full and complete disclosure of the preferred embodiments of this invention, various modifications, alternate constructions, and equivalents may be employed without departing from the true spirit and scope of the invention. Therefore, the above description and illustrations should not be construed as limiting the scope of the invention which is defined by the appended claims.

I claim:

1. A ball support device including:

a planar platform, the platform having
horizontal upper and lower surfaces and
an aperture passing vertically between the upper and lower surfaces of the platform;

at least two calks projecting from the lower surface of the platform;

an arm slideably engaged within the aperture having
a pointed ground piercing bottom end and
a straight vertical shaft portion; and a curved upper tensioning portion of the arm, the shaft portion having a cross-section of uniform size and shape from about the pointed end up to about the curved portion, whereby the arm forms an inverted J-spike that may be used as a ball holding stake independently of the remainder of the device.

2. The device of claim 1 further including:

pointed bottom calk ends; and at least one bevelled edge of the platform canting outwardly from the upper surface of the platform to the lower surface thereof.

3. The device of claim 2 further including:

a thumbscrew turnably engaged with the platform and communicating with the aperture.

4. The device of claim 3 wherein the curved upper tensioning portion terminates in a knob.

5. The device of claim 4 wherein there are at least three bevelled edges and wherein the shaft portion is smoothly cylindrical.

6. The device of claim 5 wherein the platform is made of resilient, impact-resistant material.

7. A ball support device including:

a planar platform, the platform having horizontal upper and lower surfaces and a cylindrical aperture passing vertically between the upper and lower surfaces of the platform;

at least two calks having pointed bottom calk ends and projecting from the lower surface of the platform;

an arm having a pointed ground piercing bottom end, a smoothly cylindrical straight vertical shaft portion, and a curved upper tensioning portion, the shaft portion having a constant diameter from the pointed end up to the curved portion, whereby the arm forms an inverted J-spike that may be used as a holding stake independently of the remainder of the device; and at least one bevelled edge of the platform canting outwardly from the upper surface of the platform to the lower surface thereof.

8. The device of claim 7 wherein the curved upper tensioning portion terminates in a knob.

9. The device of claim 8 wherein there are at least three bevelled edges.

10. The device of claim 9 wherein the platform is made of resilient, impact-resistant material.

11. The device of claim 10 further including:

a thumbscrew turnably engaged with the platform and communicating with the aperture.

12. A ball holding device including:

a smoothly cylindrical straight vertical shaft portion;

a pointed ground piercing bottom end on the shaft; and a curved upper tensioning portion on the shaft terminating in an enlarged knob, the shaft portion having a constant diameter from the pointed end up to the curved portion, whereby the device forms an inverted J-spike that may be used as a ball holding stake.

* * * * *